US011304551B2

(12) United States Patent
McCartney

(10) Patent No.: US 11,304,551 B2
(45) Date of Patent: Apr. 19, 2022

(54) ADJUSTABLE FOOD-PORTIONING DEVICE

(71) Applicant: Daniel McCartney, Lucan (IE)

(72) Inventor: Daniel McCartney, Lucan (IE)

( * ) Notice: Subject to any disclaimer, the term of this patent is extended or adjusted under 35 U.S.C. 154(b) by 46 days.

(21) Appl. No.: 16/612,719

(22) PCT Filed: May 11, 2017

(86) PCT No.: PCT/IE2017/000009
§ 371 (c)(1),
(2) Date: Nov. 11, 2019

(87) PCT Pub. No.: WO2018/207166
PCT Pub. Date: Nov. 15, 2018

(65) Prior Publication Data
US 2020/0163474 A1 May 28, 2020

(51) Int. Cl.
*B65D 25/06* (2006.01)
*A47G 19/30* (2006.01)
*A47G 19/02* (2006.01)

(52) U.S. Cl.
CPC ..... *A47G 19/30* (2013.01); *A47G 19/02* (2013.01); *B65D 25/06* (2013.01)

(58) Field of Classification Search
CPC ..... A47G 19/02; A47G 19/30; B65D 25/04; B65D 25/06; B65D 43/0225; B65F 1/0046
USPC ..... 220/574.1, 531, 533, 575, 528, 529
See application file for complete search history.

(56) References Cited

U.S. PATENT DOCUMENTS 1,290,186 A * 1/1919 Held ..... A47J 36/20 220/531
2,434,566 A * 1/1948 Hulsmann ..... B26D 3/245 33/525
5,062,540 A * 11/1991 Jenkins ..... B65F 1/0046 220/23.83
D395,377 S * 6/1998 Wallays ..... D7/387

FOREIGN PATENT DOCUMENTS

CN 103099413 A 5/2013
FR 1149738 A 12/1957
GB 2416669 A 2/2006
WO 2013138844 A1 9/2013

OTHER PUBLICATIONS

International Search Report and Written Opinion dated Feb. 8, 2018, for corresponding PCT Application No. PCT/IE2017/000009.

* cited by examiner

*Primary Examiner* — Don M Anderson
*Assistant Examiner* — Elizabeth J Volz
(74) *Attorney, Agent, or Firm* — Kinney & Lange, P.A.

(57) ABSTRACT

A device for portioning food, and more specifically, a device that can be adjusted so that portions of food can be varied in accordance with an individual's dietary requirements, is disclosed. Such a food-portioning device includes an annular wall, a hub, and a plurality of dividing means extending from the hub to the annular wall so as to form a plurality of spaces between the dividing means, each space having an open top and an open bottom, wherein at least one of the dividing means is attached to the hub in a manner that allows it to at least partially rotate about the hub relative to an adjacent dividing means.

12 Claims, 7 Drawing Sheets

ADJUSTABLE FOOD-PORTIONING DEVICE

CROSS-REFERENCE TO RELATED APPLICATION(S)

The present application is the national phase of PCT Application No. PCT/IE2017/000009 filed on May 11, 2017, which is hereby incorporated by reference in its entirety.

TECHNICAL FIELD

The present disclosure relates to a device for portioning food. More specifically, the present disclosure relates to a device that can be adjusted so that portions of food can be varied in accordance with an individual's dietary requirements.

BACKGROUND

Obesity has become a global epidemic in recent years, and is a key driver of escalating non-communicable disease rates in both developed and developing countries. One of the critical precipitants of obesity is the overconsumption of energy (calories), particularly in the context of the low physical activity levels which now prevail in many countries. This overconsumption of energy can arise from either an excessive volume of food intake (i.e. a quantitative excess), an excessive intake of certain food types (i.e. a qualitative excess), or more commonly, a combination of both. Often, people find it very difficult to judge the correct amount of various food types that will enable them to lose or manage their weight.

Public health initiatives advocate the use of models that are based on the qualitative issues which predispose individuals to excessive energy intake and weight gain. For example, the "Food Pyramid"—first proposed by the United States Department of Agriculture (USDA) in 1992 and updated in 2005—is a graphic representation of human nutritional needs in the form of a pyramid. In this model foods whose recommended daily intake is highest occupy the wider bottom part of the pyramid and foods whose recommended daily intake is lowest occupy the slender top part. In 2011, the USDA published a replacement guideline called "MyPlate" because it was felt that the Food Pyramid was too complex for the average family to practice easily and efficiently in daily life. In the new guideline (see FIG. 1), a plate is divided into four regions, each region being associated with a specific food type, with an additional smaller region outside the plate representing dairy products. Similar versions of the MyPlate guideline are now in use around the world (e.g. the "Eatwell Plate" as published by the Department of Health in the UK).

Various tools have been developed to assist an individual estimate and control their food portion sizes. For example, plates sold under the trade names "The Diet Plate", the "Healthy Portion Plate" and "The Balance Plate" are flat plates with pictorial and text markings on the surface showing the user—in two dimensions—how much of each different food type they should take at a meal. A similar approach is described in GB 2416669 A where, instead of using a plate to pictorially depict a two dimensional area onto which food is placed, a pre-marked removable "food template" is described which can be used to portion food on a plate.

Unfortunately, public health initiatives based solely on relative food proportions and food qualitative issues—and the tools developed to apply the principles of such initiatives are unlikely to succeed as excessive portion size (i.e. quantitative excess in terms of absolute food volume) has been highlighted in population studies as a critical determinant of dietary energy excess and weight gain ("Overcoming Obesity: An initial economic analysis", McKinsey Global Institute, 2014). For example, taking the MyPlate guideline as an example, if all of the portions are excessive (e.g. if the food is piled high or served in large portions on a large plate), the individual in question will still over-consume energy and therefore continue to gain weight.

Furthermore, there is insufficient guidance as to how the portion sizes recommended by these models should differ between people with differing energy requirements. Each individual is different in terms of their body size, body composition, gender, age, activity level and other factors, so general guidelines that are not tailored to the individual in terms of both the type and amount of food that they should consume have limited value. To the effect that they do have value, the MyPlate guidelines and the tools developed to help implement them only offer portion size guidance in two dimensions, with no reference to the vertical height of the food on the plate. In this respect they fail to adequately quantify the total quantity of food designated within each area of the plate.

Three-dimensional models for portion size estimation at mealtimes have been developed. Examples include the "EZ Weight Plate" (see US 2007/0289973 A1), the "Meal Measure Portion Control Tool" (see US 2008/0230546 A1), and the "Relaxor FF8PP Perfect Portion Plate" (see WO 01/16921 A1). While these devices aim to quantify the volume of each constituent food type in a typical meal, all are nonadjustable meaning that they have limited if any ability to prescribe different portion sizes of the food types based on an individual's own characteristics and dietary requirements.

The present disclosure overcomes the shortcomings in the prior art by permitting the correct estimation of required food portion sizes based on their three-dimensional volume, while at the same time permitting individualised portion size estimation that is appropriate to any user based on their personal characteristics (e.g. body size, gender, age, etc.).

SUMMARY

The present disclosure provides a food-portioning device, comprising:

an annular wall (2);

a hub (3); and a plurality of dividing means (4) extending from the hub to the annular wall (2) so as to define a plurality of spaces (5) between the dividing means, each space having an open top and an open bottom; wherein at least one of the dividing means is attached to the hub in a manner that allows it to at least partially rotate about the hub relative to an adjacent dividing means.

In one aspect of the present disclosure the food-portioning device (1) comprises:

an annular wall (2) wherein the annular wall has a different vertical height at different points along the periphery thereof; a hub (3); and a plurality of dividing means (4) extending from the hub (3) to the annular wall (2) so as to form a plurality of spaces (5) between the dividing means, each space having an open top and an open bottom;

wherein at least one of the dividing means is a non-rotatable dividing means attached to the hub and/or to the annular wall in a manner that does not allow that dividing means to rotate about the hub; and wherein at least one of the dividing means is a rotatable dividing means which comprises a sleeve that straddles the annular wall and is attached to the hub in a manner that allows it to at least partially rotate about the hub relative to an adjacent dividing means, further wherein said annular wall, hub and non-rotatable dividing means define a food-portioning device base portion configured for attachment of at least one said rotatable dividing means.

The present disclosure also provides a food-portioning device base portion comprising:

an annular wall (2) wherein the annular wall has a different vertical height at different points along the periphery thereof;

a hub (3); and at least one non-rotatable dividing means that is attached to the hub and/or to the annular wall in a manner that does not allow that dividing means to rotate about the hub.

The present disclosure also provides a food-portioning device rotatable dividing means in the form of a blade having a proximal end and a distal end;

wherein the proximal end of the blade is configured to attach to the hub of the food-portioning device and allow at least partial rotation about the hub; and wherein the distal end of the dividing means comprises the sleeve that is capable of straddling the annular wall.

The present disclosure also provides a kit-of-parts comprising a food-portioning device base portion according to the present disclosure as well as one or more food-portioning device rotatable dividing means according to the present disclosure.

The present disclosure also provides a method of portioning food, comprising the steps of:

providing a food-portioning device according to the present invention;

adjusting at least one dividing means so that the spaces defined by the annular wall and the plurality of dividing means correspond to the desired portioning amounts of food;

placing the device on a food-bearing surface; and placing food types in the respective spaces, the allowable size of each food portion being determined by the size of its corresponding three-dimensional space.

DETAILED DESCRIPTION

The present disclosure provides a food-portioning device that is adjustable. The term "adjustable" means that the device is configured in such a way that it can be adjusted by the user to deliver portions of food according to an individual's personal dietary requirements. In the present disclosure this is achieved by including at least one dividing means that can rotate at least partially about a central hub relative to an adjacent dividing means. By rotating at least one dividing means, the three-dimensional space between that rotatable dividing means and an adjacent dividing means can be increased or decreased as required. For instance, the user might adjust the device according to the dietary requirements of an individual based on instructions from a health practitioner, instructions provided with or for the device, or indices marked on the device itself.

The food-portioning device of the present disclosure comprises an annular wall. One purpose of the annular wall is to allow a peripheral boundary be established which, in cooperation with the plurality of dividing means, defines a plurality of three-dimensional spaces which can be used to define portion sizes. The annular wall can itself establish the peripheral boundary or it can act as a support or guide for another member of the device that establishes the peripheral boundary. The annular wall also serves to establish the plane in which the plurality of dividing means extend from the hub and in which at least one dividing means is at least partially rotatable about the central hub.

Figure 1:
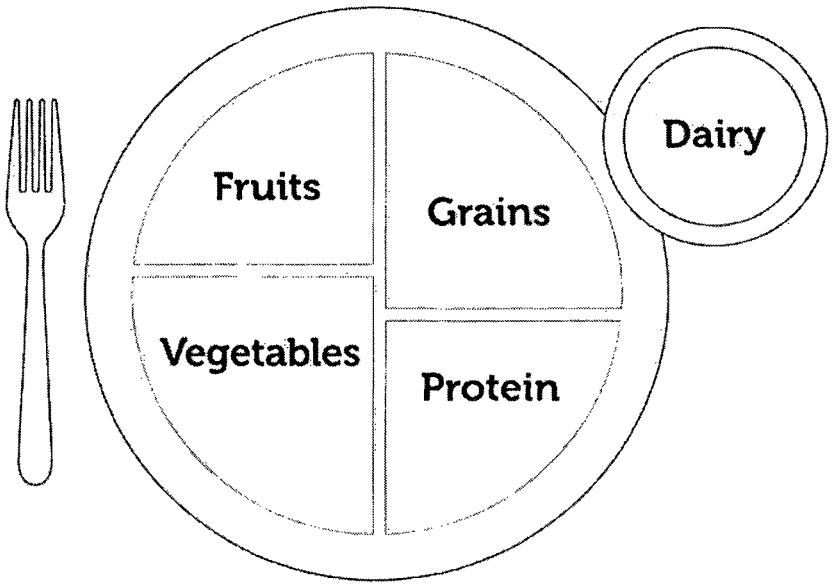
FIG. 1 depicts the USDA's "MyPlate" guideline for portioning food.
Figure 2:
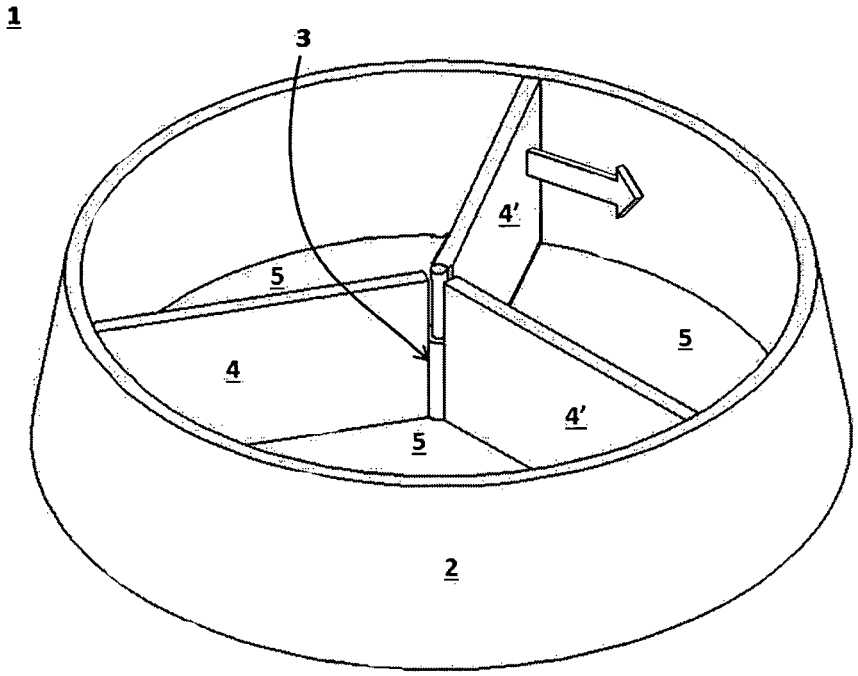
FIG. 2 depicts an embodiment of the food-portioning device according to the 15 invention.

By way of example, the food-portioning device (1) that is shown in FIG. 2 comprises an annular wall (2) and a central hub (3). The device also comprises a plurality of dividing means (4, 4', 4') which, in cooperation with the peripheral boundary, define a plurality of three-dimensional spaces (5). In this embodiment one of the dividing means (4) is fixed to the annular wall such that it does not rotate about the hub, while the other two dividing means (4') are rotatable about the hub (e.g. as shown by the block arrow). The user can easily adjust the portion size defined by the three-dimensional space on either side of the rotatable dividing means so that the desired amount of a particular food can be measured out on a plate (not shown).

In the present disclosure, the wall is annular in shape to permit rotation of a dividing means about the hub. The wall need not be a perfect annulus in a mathematical sense: any shape approaching that of a ring is sufficient provided that it allows at least one dividing means to at least partially rotate about the hub.

The cross-section and thickness of the annular wall is not particularly limited and may be appropriately determined by those skilled in the art. For instance, the cross section of the wall may be triangular, rectangular or trapezoidal in shape. The thickness of the wall (i.e. the widest horizontal part of its cross section as it sits on a flat surface) preferably lies within the range of from about 2 mm to about 20 mm. This range of thickness is preferred in view of providing suitable robustness while maintaining handleability and reducing the weight of the device. To improve the robustness of the device the wall is preferably at least 2 mm thick, more preferably at least 5 mm thick and even more preferably at least 8 mm thick. To improve handleability, the wall is preferably 20 mm thick or less, more preferably 15 mm thick or less and most preferably 12 mm thick or less. Any of the preferred lower thickness values can be combined with any of the disclosed upper thickness values to create preferred ranges for the wall thickness: e.g. 2-20 mm, 2-15 mm, 5-20 mm, and 5-15 mm.

The diameter of the annular wall is not particularly limited and may be appropriately determined by those skilled in the art. The diameter (measured between two directly opposed inner faces at the base of the wall) can be tailored according to the intended food-bearing surface that the device will be used on. For instance, for plates found in a typical household the diameter of the annular wall preferably lies within the range of from 10 cm to 40 cm, preferably from 15 to 35 cm, and more preferably from 20 to 30 cm. Any of the preferred lower diameter values can be combined with any of the preferred upper diameter values to create other preferred diameter ranges for the annular wall: e.g. 10-35 cm, 10-30 cm, 15-40 cm, and 15-30 cm.

Figure 3:
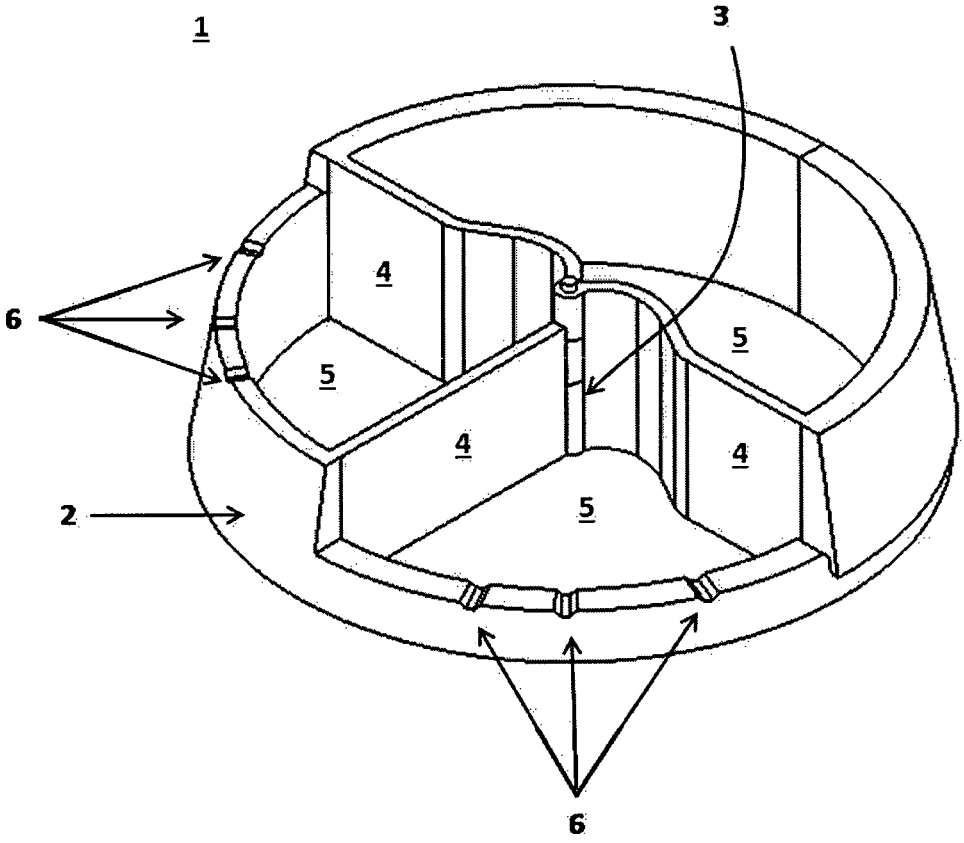
FIGS. 3 and 4 depict a further embodiment of the food-portioning device according to the invention.
Figure 5:
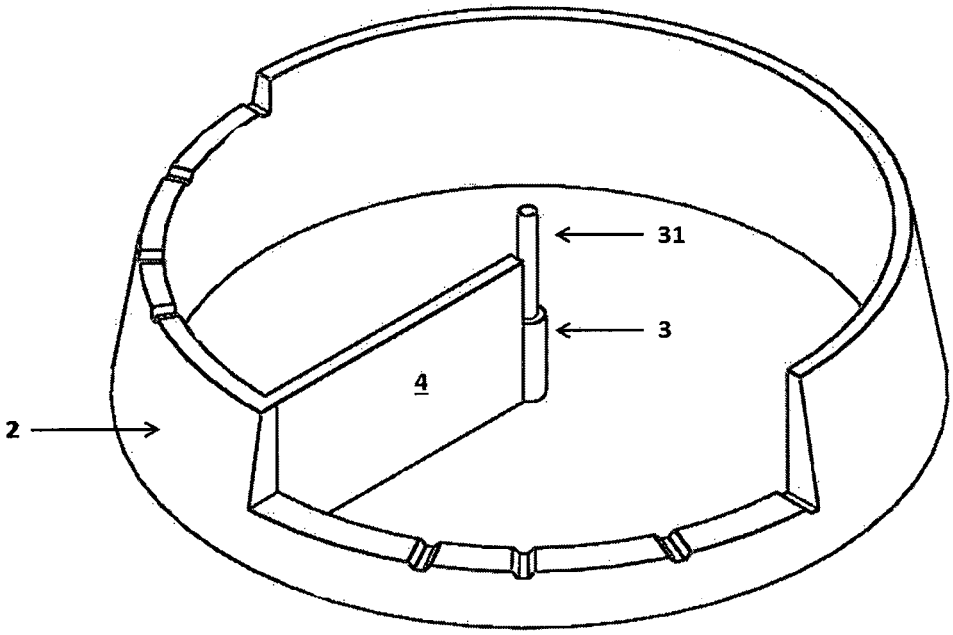
FIG. 5 depicts an exemplary base portion that can be used together with attachable dividing means to form an adjustable food-portioning device according to the invention.

The height of the wall (i.e. the highest vertical part of its cross section as it sits on a flat surface) is not particularly limited and may be appropriately determined by those skilled in the art. For instance, the height of the wall preferably lies within the range of from about I cm to 10 cm. The height of the wall can be approximately constant around its circumference (an example of which is shown in FIG. 2) or it can have different heights at various points around its circumference (an example of which is shown in FIG. 3). For instance, from a plan perspective, the circumference of the annular wall can be considered of as a series of contiguous arcs (e.g. two, three, four or more arcs), where the height of the wall for any one arc is approximately constant but is different than the height of the wall for an adjacent arc. By way of example, the annular wall of the baseplate that is depicted in FIG. 5 can be considered of as a series of three arcs (extending approximately 180°, 45°, and 45°, around the 5 circumference, respectively), each arc having approximately constant height.

The annular wall may contain a plurality of raised parts (e.g. raised dots or ridges) or indentations (e.g. notches or grooves) that engage with a rotatable dividing means to guide and/or hold the rotatable dividing means at a position while it is being used to portion out food. For example, a part of the rotatable dividing means can be made to protrude over the top of the annular wall and engage with a raised part or indentation on the wall to impede further movement of the dividing means at that point. This allows the dividing means to be held in place while food is being portioned and hinders the dividing means from inadvertently moving to a different position. The protrusion can be any shape or form that suitably interacts with a raised part or indentation on the annular wall. The number of raised parts and/or indentations is not particularly limited and may be appropriately determined by those skilled in the art. In some embodiments the position of the raised parts and/or indentations also acts as a guide for where to place the rotatable dividing means in order to portion a predetermined amount of food for an individual having a particular dietary requirement. FIG. 3 depicts an embodiment where the top of the annular wall has indentations (in this case three grooves on each of the 90° arcs) along part of its circumference. These grooves or notches interrupt the otherwise smooth rotation of the rotatable dividing means and assist the user in measuring out correct 25 portions of food.

The hub, sometimes referred to herein as the "central hub", is that part of the device from which the plurality of dividing means radiate. The hub need not be at the exact geometric centre of the device: it suffices that it is positioned such that at least one 30 dividing means can at least partially rotate about the hub.

Figure 4:
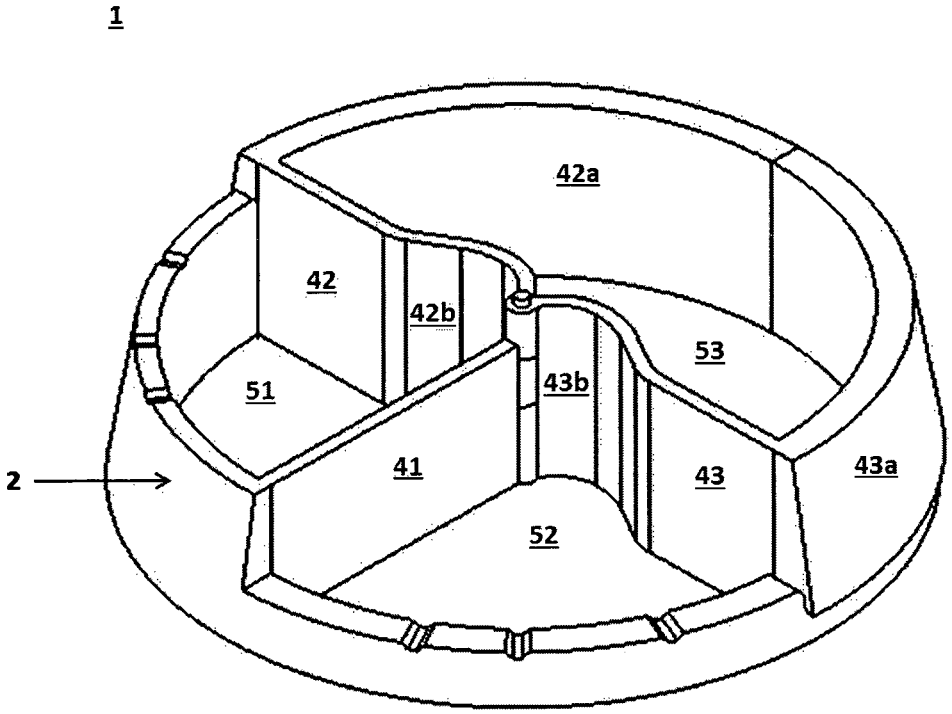

In one embodiment the hub is permanently fixed in position with respect to the annular wall. By way of example, the hub can be fixed in position by one or more non-rotatable dividing means (as depicted in FIG. 5). The central hub can be a separate component that is physically attached to the non-rotatable dividing means or it can be integrally formed therewith. In one embodiment all of the dividing means are removable but at least one is capable of being supported by the annular wall (e.g. by an appropriately formed sleeve). In this case the central hub need not be permanently fixed in position with respect to the annular wall but rather comes into being as the device is assembled. For instance, if dividing means (41) in FIG. 4 is not attached to the annular wall (2) but instead comprises a sleeve similar to sleeves (42*a*) or (43*a*), the hub is not permanently fixed in position but 10 comes into being when dividing means (41) is attached to the annular wall via its arc-shaped sleeve.

The dividing means can be considered to have a proximal end that connects with the hub and extends therefrom to a distal end that cooperates with the peripheral boundary to define spaces that can be used to portion food when the device is placed on a food bearing surface, such as a plate. The dividing means may be of any shape or size suitable for partitioning food. Preferably, the dividing means are blade shaped. The height of each dividing means is not particularly limited and may be appropriately determined by those skilled in the art. For example, the height of the 20 dividing means may lie within the range of from about 1 cm to 10 cm.

Since the dividing means converge at the hub, the space between adjacent dividing means becomes increasingly narrow as one approaches the hub. This can make it difficult to fully fill that space with food or clean the device after use. One way to overcome this problem is to increase the width of the central hub so that the proximal ends of the plurality of dividing means are kept further apart. Another way to overcome the problem is to use rotating dividing means that are bent or curved at their proximal end. This greatly simplifies the configuration of the hub for accommodating rotatable dividing means since it is preferable that the proximal ends of the rotating dividing means contact or form the hub as centrally as possible. For instance, in the embodiment depicted in FIG. 4, the two rotatable dividing means (42, 43) have a curved portion (42*b*, 43*b*—see also FIG. 5) at the proximal end that connects to the central hub. When each dividing means is rotated towards the fixed dividing means (41), the curved portions (42*b*) and (43*b*) provide an enlarged space at the hub where all three dividing means converge.

Figure 6:
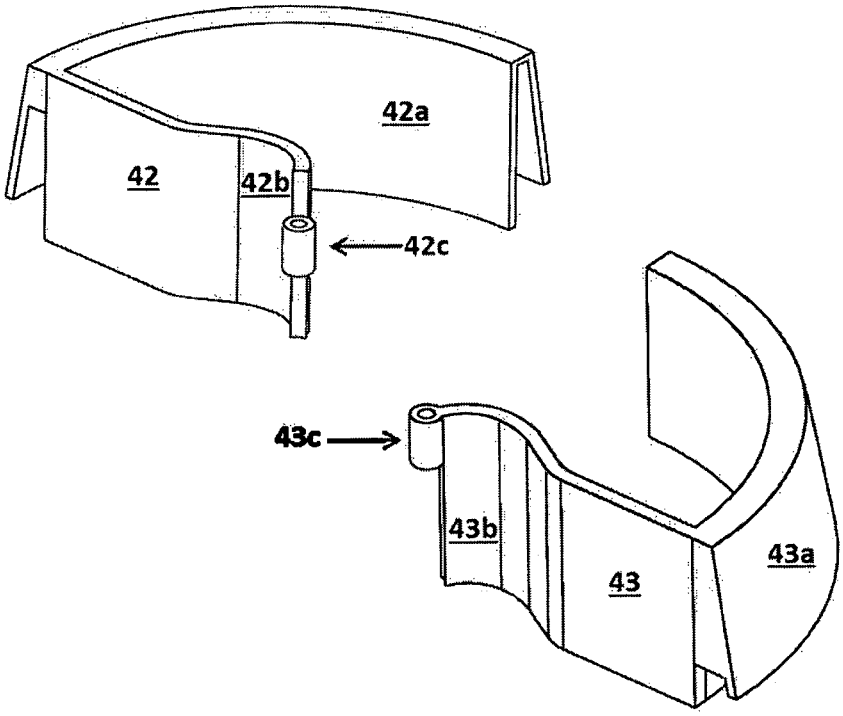
FIG. 6 depicts two exemplary dividing means that can be used together with the base portion of FIG. 5.

For the purposes of this disclosure, the way by which the dividing means connect to or form the hub is not particularly limited and may be appropriately determined by those skilled in the art, provided that at least one dividing means can at least partially rotate about the hub relative to an adjacent dividing means. In one embodiment the hub comprises a pin which connects the plurality of dividing means. By way of example, in FIG. 5 the central hub (3) is fixed in position relative to the annular wall (2) and comprises a pin (31) onto which one or more additional dividing means may be removably attached. Two such dividing means (42, 43) are depicted in FIG. 6. In this embodiment the dividing means comprise a blade portion having a proximal end (the end that attaches to the hub) and a distal end (the end nearest the annular wall). The proximal end of the blade is configured to attach to the central hub of the adjustable food-portioning device by a knuckle (42*c*, 43*c*) although any means that allows removable attachment to the hub can be employed. A knuckle-type attachment or similar is advantageous as it also allows the removable dividing means to easily rotate about the hub.

Preferably, the device comprises at least one dividing means that is attached to the central hub and/or to the annular wall in a manner that does not allow that dividing means to rotate about the central hub (see, e.g. dividing means (4) in FIG. 2 or dividing means (41) in FIG. 4). The rotatable dividing means may contact the annular wall provided that such contact does not prevent the user from adjusting the position of the dividing means. For instance, in FIG. 2 the two rotatable dividing means (4') extend and touch the annular wall but can still be partially rotated about the hub (3). In FIG. 4 the two rotatable dividing means (42, 43) extend to and protrude over the annular wall but can still be partially rotated about the hub.

Figure 7:
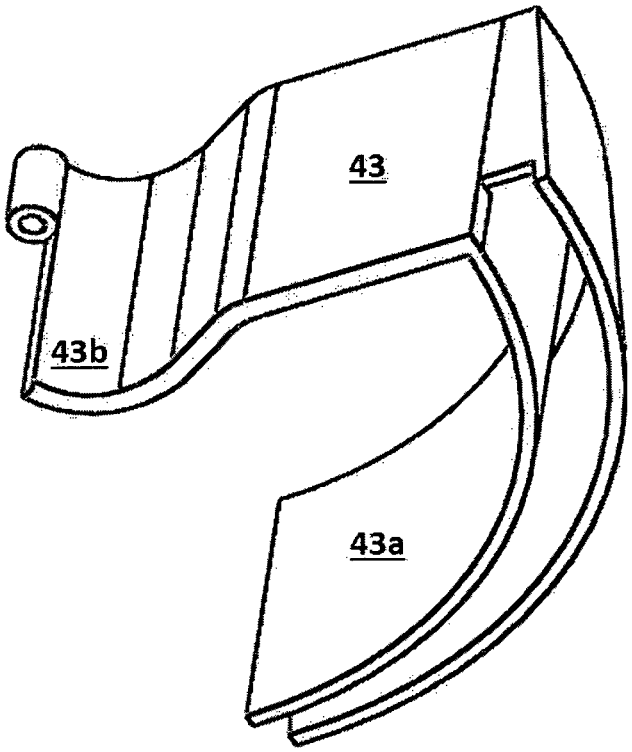
FIG. 7 depicts the underside of a dividing means of FIG. 6.

In an embodiment, one or more of the rotatable dividing means may comprise a part that cooperates with the annular wall to provide additional support for the rotatable dividing means. One example of such a part is an inverted V-guide or sleeve that straddles the annular wall. In a preferred embodiment the sleeve is arc-shaped but any shape that is capable of allowing the dividing means to be guided by the annular wall will suffice. The embodiment in FIGS. 3 and 4 depicts such sleeves. The sleeve is advantageous in that it serves to support the rotatable dividing means at the annular wall thus improving the robustness of the device. Furthermore, the annular wall acts as a guide rail on which the sleeve travels, thus making it easier to rotate and accurately position the dividing means at a desired location. FIG. 7 depicts the underside of dividing means (43) showing the sleeve-like shape that allows the dividing means to be guided by the annular wall.

Referring to FIG. 4, one of the dividing means (41) can be fixed such that it cannot rotate about the hub relative to the annular wall. The other two dividing means in this embodiment (42, 43) are rotatably attached to the central hub so that each can be rotated about the central hub within the plane defined by the annular wall. Spaces (51), (52) and (53) are defined by adjacent dividing means and the peripheral boundary. In the configuration depicted in FIG. 4, the annular wall (2) itself establishes the peripheral boundary for approximately one half of the device. For the other half of the device the annular wall acts as a support for sleeves (42*a*) and (43*a*) which are attached to the distal end of rotatable dividing means (42) and (43), respectively (the proximal end is the end that attaches to the hub). For this half of the 20 device the sleeves (42*a*) and (43*a*) establish the peripheral boundary by which space (53) is defined.

The size of spaces (51), (52) and (53) can be adjusted as required. For instance, referring to the particular configuration depicted in FIG. 3, as the dividing means (42) and (43) are rotated towards dividing means (41), the spaces (51) and (52) which are defined by dividing means (41), (42) and (43), together with the peripheral boundary defined by annular wall (2), become smaller. Similarly, space (53), which is defined by dividing means (42) and (43), together with the peripheral boundary defined by sleeves (42*a*), (43*a*) and the now-exposed portion of annular wall (2) between sleeves (42*a*) and (43*a*), becomes larger. Sleeves (42*a*) and (43*a*) can also be designed such that one overlaps the other thus providing a continuous sleeve boundary as the dividing means (42) and (43) rotate.

If the annular wall has different heights at various points around its circumference, the rotatable dividing means may be provided with a part that ensures an approximately constant height of the peripheral border as the dividing means moves to a part of the wall having a lower height. This allows the user to portion out food more accurately. For instance, in FIG. 4 the sleeve (43*a*) serves not just as a support and guide for the dividing means (43), it also ensures that the peripheral boundary that helps to define space (53) has an approximately constant height, even if the dividing means (43) is rotated towards dividing means (41) and to a part of the device where the annular wall has a lower height. While in FIG. 4 this part is shown to be a sleeve, it can be any 10 part that serves the same function, such as an extension of the dividing means that bends at the annular wall and curves along the inside of the annular wall.

One advantage of the present device is that the height of the peripheral boundary can be used to define how high food should be piled. This makes it much easier to deliver the correct amount of the food by, for example, levelling off the food and removing any excess with a spatula. Where the device has an annular wall having different heights, a lower height can be used to spread the three-dimensional space over a larger area to accommodate foodstuffs that do not easily flow into a space, such as meat. Without the lower height wall, to achieve the same volume such food stuffs 20 would have to be placed in a comparatively narrower space which could prove difficult.

The wall may also comprise one or more markings (not shown in the Figures) on its outer or inner face to indicate how high food should be piled in a particular space. When such markings are used, it is preferable that they be placed on the inner face of the wall to reduce errors in measuring the correct height of the food. The dividing means may also comprise one or more markings on either side to indicate how high food should be piled in the space adjacent that dividing means. In one embodiment, the height of the wall optionally in cooperation with height markings on the dividing means, is used to define how high food should be piled in that space. For example, the height marking on the dividing means may correspond to the height of a lower portion of wall adjacent to that dividing means to assist the user to determine how high food should be piled in that space. By using the height of the wall as a guide to determine how high food should be piled in a space, the problem of markings on the wall or the dividing means becoming obstructed by food is mitigated.

Where the height of the markings on the wall, or preferably the height of the wall itself, differs at various points around the circumference of the annular wall, the spaces can be assigned to particular food groups. For example, the space into which a protein-rich food (e.g. meat or fish) is placed may be defined by a marking or part of the annular wall having a lower height than the space into which a carbohydrate-rich food (e.g. potato or rice) is placed. By way of example, and with reference to FIG. 4, spaces (51) and (52) are partly defined by annular wall (2). However, the height of annular wall (2) is higher for space (51) than it is for space (52) which means that the volume of the three-dimensional space (51) is greater than the volume of the three-dimensional space (52), for any given fixed area (from a plan perspective). Thus, space (52) could be designated as the space for portioning, for example, protein-rich food whereas space (51) could be designated as the space for portioning, for example, carbohydrate-rich food. It will be appreciated that by utilizing height markings on the inner or outer face of the wall and/or on either side of the dividing means, or by utilizing an annular wall with varying height, spaces having the same area (from a plan perspective) can still be used to portion different quantities of food. The combination of height differences in the wall and dividing means, or markings thereon, together with the use of a rotatable dividing means, greatly increases the number of possible food portions that can be measured out with the device.

The dividing means may also comprise markings to indicate how high food should be piled in a particular space. In the case that the dividing means comprises a part at its distal end designed to maintain a constant height at the peripheral border (e.g. a sleeve), that part may be used to define how high food should be piled in that space. The height of the part is not particularly limited but preferably it provides a constant height along that part of the annular wall that it cooperates with. The advantage of this set-up is that the height of the peripheral boundary remains constant as the dividing means is rotated. This is particularly useful if the height of the peripheral boundary is used to determine how high food should be piled up in the space partly defined by e.g. a sleeve. For instance, referring to FIG. 4, as dividing means (42) and/or (43) rotate towards dividing means (41), sleeves (42*a*) and (43*a*) can provide a relatively constant height (e.g. if one overlaps the other or the height difference from the underlying annular wall is insignificant) so that the height of space (53) remains constant 5 although its total volume increases.

The device may be made of any suitable material or mix of materials and produced by suitable means known in the art such as injection moulding, casting, pressing, carving or 3D printing. It may be constructed as a single use, disposable, device but preferably it is constructed for multiple use applications. Preferably the device is made of a relatively durable material that is easily cleaned, and is preferably also dishwasher safe. For instance, the outer wall and dividing means of the device may be made of a plastic material, for example polycarbonate or polypropylene, such as FDA-approved polypropylene. Preferably, any plastic material that is used is BPA-free, phthalate15 free, and PVC-free. Other materials that may also be used include wood-based materials, ceramic materials, glass materials, and metallic materials such as stainless steel or aluminium. Different parts of the device can be made of different materials.

In one embodiment, the device can be adapted to resemble a human, animal, or fictitious character's face. In this embodiment, the three-dimensional area defined by two dividing means, the attached sleeves (if present) and the annular wall can be made to resemble the smile of a face. The "smiling" space (space 53 in FIG. 3) can be designated the salad and/or vegetable space, such that the smile of the face grows larger as the portion size of the salad and/or vegetable increases thus encouraging users of the device, or those that ultimately receive the portioned food, especially children, to accept increased portions of a particular food group such as salad and/or vegetable.

While the adjustable food-portioning device of the present disclosure is particularly useful to allow individuals estimate and control their own food portion sizes, it can also be used more generally wherever there is a need to control food portions, for example, in schools, hospitals, military installations or prisons.

In a preferred embodiment, the adjustable food-portioning device is made up of a base portion and one or more (preferably two or three) removable dividing means. In this embodiment the base portion comprises an annular wall (2), a hub (3) and a dividing means (41) that is attached to the hub and the annular wall in a manner that does not allow that dividing means to rotate about the hub. An exemplary base portion is that depicted in FIG. 5. The one or more removable dividing means are attachable to the hub in a manner that allows them to rotate about the hub. Preferably, the one or more removable dividing means each comprise a sleeve on the distal end of the dividing means to allow the dividing means be supported and/or guided by the annular wall when rotated about the hub. The one or more dividing means can be provided together with the base portion (e.g. as a kit-of-parts) or provided separately (e.g. as accessories) to the base portion.

The adjustable food-portioning device of the present disclosure is easy to use and the present disclosure extends to a method of portioning food using the device. For instance, one method for portioning food using the device comprises the steps of adjusting at least one dividing means so that the spaces defined by the peripheral boundary and the plurality of dividing means corresponds to the desired portioning amounts of food; placing the device on a food-bearing surface; and placing food types in the respective spaces, the allowable size of each food portion being determined by the size of its corresponding three-dimensional space. By way of example, and referring to the device depicted in FIG. 4, the size of spaces (51), (52) and (53) can be adjusted to a predetermined volume by rotating dividing means (42) and (43). The device can then be placed on a food-bearing surface such as a plate. Protein-rich food is portioned using space (52), carbohydrate-rich food is portioned using space (51), and salad and/or vegetables are portioned using space (53). The device can then be removed (although this is not necessary) so that the correctly portioned meal can be enjoyed.

The invention claimed is:

1. A food-portioning device, comprising:

an annular wall;

an elongate hub; and a plurality of dividing means, each dividing means comprising a partition wall extending from the elongate hub to the annular wall so as to form a plurality of spaces between the dividing means and the annular wall, each space having an open top and an open bottom, and each space being suitable to receive food and to portion the food;

wherein the elongate hub extends in the direction of the partition wall;

wherein at least one of the dividing means is attached to the elongate hub in a manner that allows it to at least partially rotate about the hub relative to an adjacent dividing means; and wherein the at least one dividing means that is capable of rotating about the elongate hub further comprises a sleeve that straddles the annular wall.

2. The device according to claim 1, wherein at least one of the dividing means is attached to the elongate hub and/or to the annular wall in a manner that does not allow that dividing means to rotate about the elongate hub.

3. The device according to claim 1, wherein one of the dividing means is attached to the elongate hub and/or to the annular wall in a manner that does not allow that dividing means to rotate about the elongate hub, and all others of the dividing means are attached to the elongate hub in a manner that allows them to at least partially rotate about the elongate hub relative to the non-rotatable dividing means.

4. The device according to claim 1, having two, three, four, five, six, seven or eight dividing means.

5. The device according to claim 1, having three dividing means, wherein one of the dividing means is attached to the annular wall in a manner that does not allow that dividing means to rotate about the elongate hub and the other two dividing means are attached to the elongate hub in a manner that allows them to at least partially rotate about the elongate hub relative to the non-rotatable dividing means.

6. The device according to claim 1, wherein one or more of the dividing means is removably connected to the elongate hub.

7. The device according to claim 1, wherein one or more of the dividing means is shaped such that a part thereof at which it connects to the elongate hub is inclined or curved relative to a normal of the remainder thereof.

8. The device according to claim 1, wherein the annular wall has a different vertical height at different points along a periphery thereof.

9. The device according to claim 1, wherein the annular wall comprises notches or grooves to engage the at least one rotatably connected dividing means in a plurality of fixed positions.

10. A method of portioning food, comprising the steps of:

providing the food-portioning device according to claim 1;

adjusting the at least one rotatable dividing means so that the spaces defined by the peripheral boundary and the plurality of dividing means correspond to the desired portioning amounts of different food types; and placing the different food types in the respective spaces, the allowable size of each food portion being determined by the size of its corresponding three-dimensional space.

11. A food-portioning device comprising:

an annular wall, wherein the annular wall has a different vertical height at different points along a periphery thereof;

an elongate hub; and a plurality of dividing means, each dividing means comprising a partition wall extending from the elongate hub to the annular wall so as to form a plurality of spaces between the dividing means and the annular wall, each space having an open top and an open bottom, and each space being suitable to receive food and to portion the food;

wherein the elongate hub extends in the direction of the partition wall;

wherein at least one of the dividing means is a non-rotatable dividing means attached to the elongate hub and/or to the annular wall in a manner that does not allow that dividing means to rotate about the elongate hub;

wherein at least one of the dividing means is a rotatable dividing means which comprises a sleeve that straddles the annular wall and is attached to the elongate hub in a manner that allows it to at least partially rotate about the elongate hub relative to an adjacent dividing means; and wherein said annular wall, elongate hub and non-rotatable dividing means define a food-portioning device base portion configured for attachment of at least one said rotatable dividing means.

12. The food portioning device according to claim 11, wherein the partition wall of the at least one rotatable dividing means is in the form of a rotatable partition wall having a proximal end and a distal end;

wherein the proximal end of the rotatable partition wall is configured to attach to the elongate hub of the food-portioning device and allow at least partial rotation about the elongate hub; and wherein the distal end of the rotatable partition wall comprises the sleeve that is capable of straddling the annular wall.

* * * * *